US007726777B2

(12) United States Patent
Min et al.

(10) Patent No.: US 7,726,777 B2
(45) Date of Patent: Jun. 1, 2010

(54) INKJET PRINT HEAD AND METHOD OF FABRICATING THE SAME

(75) Inventors: Jae-Sik Min, Suwon-si (KR); Kang-Soo Chu, Tacan-eub (KR); Young-Ung Ha, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 946 days.

(21) Appl. No.: 11/233,005

(22) Filed: Sep. 23, 2005

(65) Prior Publication Data

US 2006/0103693 A1 May 18, 2006

(30) Foreign Application Priority Data

Nov. 15, 2004 (KR) ..... 10-2004-0093288
Mar. 4, 2005 (KR) ..... 10-2005-0018345

(51) Int. Cl.
*B41J 2/135* (2006.01)

(52) U.S. Cl. ..... 347/44

(58) Field of Classification Search ..... 347/44, 347/61, 63
See application file for complete search history.

(56) References Cited

U.S. PATENT DOCUMENTS 5,825,385 A * 10/1998 Silverbrook ..... 347/56
7,018,018 B2 * 3/2006 Kim ..... 347/58
7,028,402 B2 * 4/2006 Miyamoto et al. ..... 29/890.1
2004/0085410 A1 5/2004 Miyata
2004/0160486 A1 8/2004 Kim

FOREIGN PATENT DOCUMENTS

CN 1496835 5/2004

(Continued)

OTHER PUBLICATIONS

Chinese Office Action dated Dec. 7, 2007 issued in CN 200510124800.5.

(Continued)

*Primary Examiner*—An H Do
(74) *Attorney, Agent, or Firm*—Stanzione & Kim LLP

(57) ABSTRACT

An inkjet print head and method of fabricating the same. The inkjet print head includes: a substrate having an ink-feed hole, an interlayer dielectric layer formed around the ink-feed hole on the substrate, at least one metal layer formed on the interlayer dielectric layer, and an anti-moisture part formed between the ink-feed hole and the at least one metal layer to prevent ink moisture in the ink-feed hole from contacting the at least one metal layer. The inkjet print head and the method of fabricating the same are capable of preventing problems such as de-lamination between layers, electrical short-circuit, circuit malfunction, and corrosion of a metal interconnection layer, since it is possible to prevent penetration of ink moisture from layers having absorbent characteristics into the metal interconnection layer, a logic region, or a pressure driving part. Therefore, it is possible to improve the lifespan and reliability of the inkjet print head as well as to increase productivity and reduce manufacturing cost by increasing yield.

36 Claims, 11 Drawing Sheets

FOREIGN PATENT DOCUMENTS

| | | |
|---|---|---|
| EP | 1428662 | 6/2004 |
| JP | 62016163 | 1/1987 |
| JP | 2001-162803 | 6/2001 |
| JP | 2001-270120 | 10/2001 |
| JP | 2004-90637 | 3/2004 |
| KR | 2004-13853 A | 2/2004 |

OTHER PUBLICATIONS

Office Action issued Dec. 19, 2008 in Chinese Application No. 2005101248005.

European Search Report issued May 15, 2009 in EP Application No. 05257065.2.

* cited by examiner

INKJET PRINT HEAD AND METHOD OF FABRICATING THE SAME

CROSS-REFERENCE TO RELATED APPLICATIONS

This application claims the benefit of Korean Patent Application No. 2004-93288, filed Nov. 15, 2004 and Korean Patent Application No. 2005-18345, filed Mar. 4, 2005, the disclosures of which are hereby incorporated herein by reference in their entirety.

BACKGROUND OF THE INVENTION

1. Field of the Invention

The present general inventive concept relates to an inkjet print head and a method of manufacturing the same, and more particularly, to an inkjet print head mounted on an inkjet printer to eject ink in fine droplets and a method of manufacturing the same.

2. Description of the Related Art

A conventional inkjet print head ejects fine droplets of ink onto a surface of a recording medium through a nozzle to obtain a desired image. The inkjet print head is generally classified, depending on a pressure generating element, as a thermal head type for generating bubbles using heat applied to the ink through an electro-thermal transducer or a piezoelectric head type for generating bubbles in the ink using pressure applied to the ink through an electro-mechanical transducer.

Regarding the thermal head type, current is applied to a heat resistor to heat the ink to a temperature of hundreds of degrees in order to boil the ink, thereby generating the bubbles. As the bubbles expand, the ink that is temporarily stored in an ink chamber is pressurized and is ejected through the nozzle.

A thermal inkjet print head typically has several hundreds of densely integrated nozzles in order to increase dots per inch (DPI).

The thermal inkjet print head is manufactured by forming a plurality of layers on a silicon substrate. Specifically, a logic region for controlling current supplied to the heat resistor used to operate the inkjet print head is formed on a wafer, and then an interlayer dielectric (ILD) layer, a metal interconnection layer, and an intermetal dielectric (IMD) layer are sequentially deposited on the logic region. Thereafter, an ink-feed hole and a nozzle are formed to extend through the layers, thereby completing the inkjet print head.

In this process, the interlayer dielectric layer should have a high degree of flatness since it is formed directly on the logic region. For this reason, conventional interlayer dielectric layers are generally made of boron phosphorus silicate glass (BPSG) having a high viscosity.

Since the BPSG has moisture absorption properties and the interlayer dielectric layer has an end that is typically exposed to the ink-feed hole to be in direct contact with the ink, the BPSG tends to absorb moisture from the ink. As a result, problems such as interface de-lamination, corrosion and electrical short-circuit of the metal interconnection layer and the heater, device malfunction in the logic region, etc., are generated. Such problems deteriorate characteristics of the inkjet print head and shorten its lifespan.

SUMMARY OF THE INVENTION

The present general inventive concept provides an inkjet print head and a method of fabricating the same having an ink absorption passage that is blocked from an ink-feed hole.

Additional aspects and advantages of the present general inventive concept will be set forth in part in the description which follows and, in part, will be obvious from the description, or may be learned by practice of the present general inventive concept.

The foregoing and/or other aspects of the present general inventive concept are achieved by providing an inkjet print head including: a substrate having an ink-feed hole, an interlayer dielectric layer formed around the ink-feed hole on the substrate, at least one metal layer formed on the interlayer dielectric layer, and an anti-moisture part formed between the ink-feed hole and the at least one metal layer to prevent ink moisture in the ink-feed hole from contacting the at least one metal layer.

A logic region may be formed on the substrate, and the anti-moisture part may be formed between the ink-feed hole and the logic region.

The anti-moisture part may be formed as an anti-moisture layer filling in a portion of the interlayer dielectric layer.

The interlayer dielectric layer may comprise boron phosphorus silicate glass.

The anti-moisture layer may comprise one of stainless steel, nickel, monel, hastelloy, lead, aluminum, tin, titanium, tantalum, and any alloy thereof.

The at least one metal layer may include a first metal interconnection layer, a second metal interconnection layer in contact with the first metal interconnection layer, and a heat resister layer in contact with the second metal interconnection layer to generate pressure.

The substrate may include a field oxide layer, the interlayer dielectric layer formed on the field oxide layer, the first metal interconnection layer formed on the interlayer dielectric layer, an intermetal dielectric layer formed on the first metal interconnection layer, the second metal interconnection layer and the heat resistor layer formed on the intermetal dielectric layer, and a passivation layer formed on the second metal interconnection layer and the heat resistor layer.

The anti-moisture part may include a trench formed around the ink-feed hole and extending from the passivation layer to the substrate, and an anti-moisture layer filling the trench.

The passivation layer and the anti-moisture layer may be formed of tantalum.

The passivation layer may include a metal passivation layer and an anti-cavitation layer, and the anti-moisture layer may be formed together with the metal passivation layer and the anti-cavitation layer.

The metal passivation layer may comprise silicon nitride, and the anti-cavitation layer may comprise tantalum.

The passivation layer may be formed on the at least one metal layer, and the anti-moisture part may include a step formed around the ink-feed hole toward the substrate and an anti-moisture layer formed on the step together with the passivation layer.

The passivation layer may include a metal passivation layer made of silicon nitride and an anti-cavitation layer made of tantalum deposited on the metal passivation layer.

The anti-moisture layer may be formed of a layered structure of silicon nitride and tantalum.

The foregoing and/or other aspects of the present general inventive concept are also achieved by providing a method of fabricating an inkjet print head including: forming an interlayer dielectric layer on a substrate, forming a metal layer on the interlayer dielectric layer, forming an intermetal dielectric layer on the metal layer, etching the intermetal dielectric layer and the interlayer dielectric layer to form a trench on a surface of the substrate around a region where an ink-feed hole is to be formed, filling the trench in the intermetal dielectric layer and the interlayer dielectric layer to form a passivation layer on the metal layer and an anti-moisture layer in the trench, forming at least one nozzle over the passivation layer, and forming the ink-feed hole to extend through the substrate adjacent to the anti-moisture layer.

The interlayer dielectric layer may comprise boron phosphorus silicate glass.

The passivation layer may include an anti-cavitation layer made of tantalum.

The passivation layer may include a metal passivation layer formed of silicon nitride under the anti-cavitation layer.

The foregoing and/or other aspects of the present general inventive concept are also achieved by providing a method of fabricating an inkjet print head including: forming an interlayer dielectric layer on a substrate, forming a trench in the interlayer dielectric layer around a region where an ink-feed hole is to be formed, filling the trench in the interlayer dielectric layer with an anti-moisture material to form an anti-moisture layer, forming at least one metal layer on the interlayer dielectric layer around the anti-moisture layer, forming a passivation layer on the at least one metal layer, forming at least one nozzle over the passivation layer, and forming the ink-feed hole to extend through the substrate adjacent to the anti-moisture layer.

The interlayer dielectric layer may comprise boron phosphorus silicate glass.

The anti-moisture material may comprise one of stainless steel, nickel, monel, hastelloy, lead, aluminum, tin, titanium, tantalum, and any alloy thereof.

The foregoing and/or other aspects of the present general inventive concept are also achieved by providing a method of fabricating an inkjet print head including: forming an interlayer dielectric layer on a substrate, forming at least one metal layer on the interlayer dielectric layer, partially forming an ink-feed hole in the interlayer dielectric layer to extend to a surface of the substrate adjacent to the at least one metal layer; forming a passivation layer on the at least one metal layer and having an anti-moisture part recessed between the at least one metal layer into the partially formed ink-feed hole, forming a nozzle layer and at least one nozzle over the passivation layer, and etching the substrate to make the partially formed ink-feed hole extend through the substrate.

An intermetal dielectric layer may be formed between the at least one metal layer and the passivation layer.

The interlayer dielectric layer may comprise boron phosphorus silicate glass.

The passivation layer may include an anti-cavitation layer made of tantalum, and a metal passivation layer formed of silicon nitride under the anti-cavitation layer.

The anti-moisture part may be made of tantalum.

The anti-moisture part may include silicon nitride formed under the tantalum.

The ink-feed hole may have a larger width in the interlayer dielectric and the at least one metal layers on the substrate than within the substrate.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
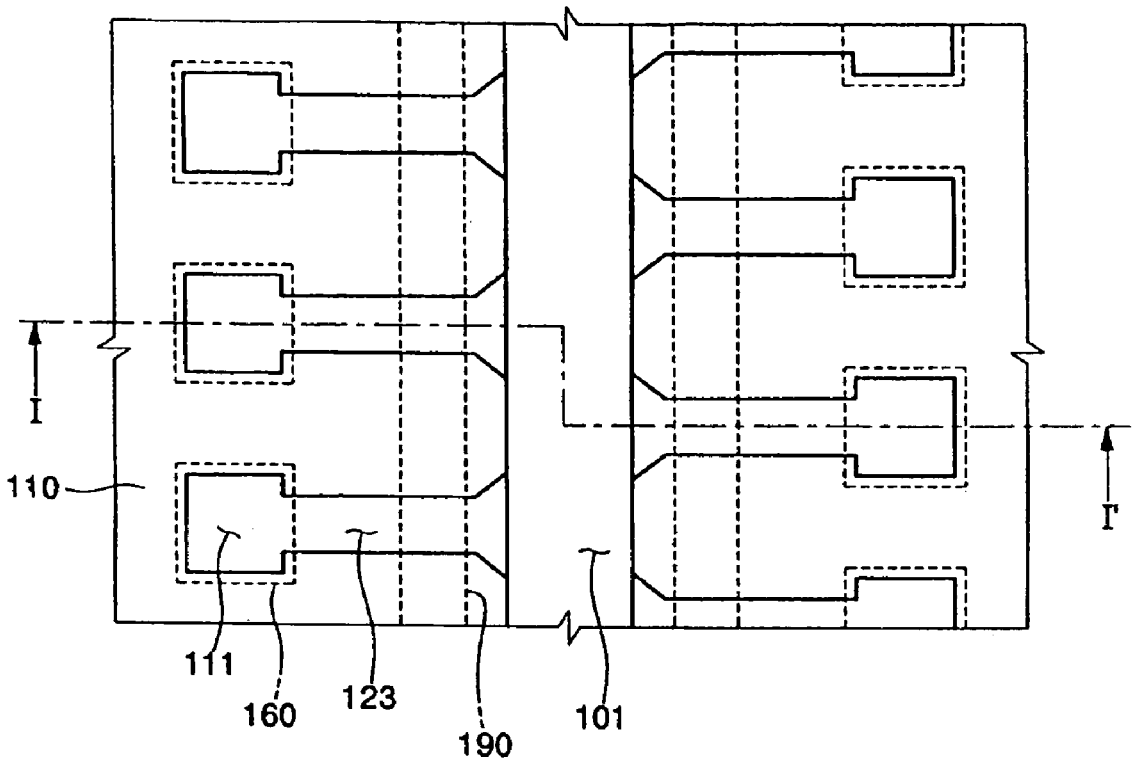
FIG. 1 is a plan view of an inkjet print head according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures. In the drawings, the thickness of the layers and regions may be exaggerated for illustration purposes. In addition, while FIG. 1 is a plan view of an embodiment of the present general inventive concept, plan views of other embodiments can be similar to FIG. 1.

Figure 2:
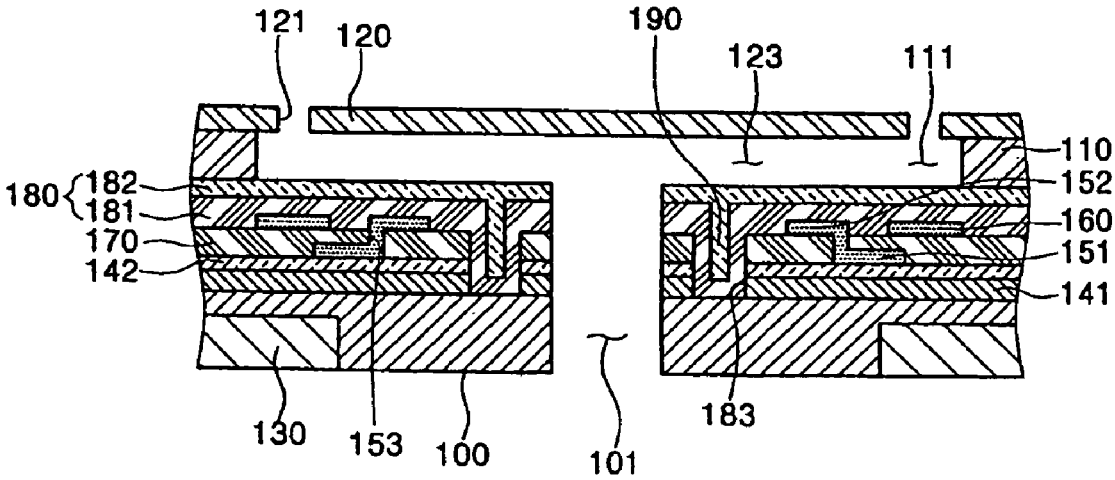
FIG. 2 is a cross-sectional view of the inkjet print head of FIG. 1 taken along line I-I'.

FIG. 1 is a plan view of an inkjet print head according to an embodiment of the present general inventive concept having a nozzle layer, which is not shown for illustration purposes, and FIG. 2 is a cross-sectional view of the inkjet print head of FIG. 1 including the nozzle layer according to an embodiment of the present general inventive concept. The inkjet print head of FIGS. 1 and 2 will also be described with reference to the method illustrated in FIGS. 3A through 3E.

Referring to FIGS. 1 and 2, the inkjet print head has a substrate 100. The substrate 100 may be a silicon wafer having a thickness of hundreds of μm (micrometers). A logic region 130, including driving devices to drive a heat resistor layer 160 serve as a pressure generating part in the inkjet print head, is formed on a portion of an upper surface of the substrate 100.

The logic region 130 may be formed through a complementary metal-oxide-semiconductor (CMOS) process. The CMOS process is disclosed in Korean Patent Laid-open Publication No. 2004-54432, filed by the present applicant.

Figure 3A:
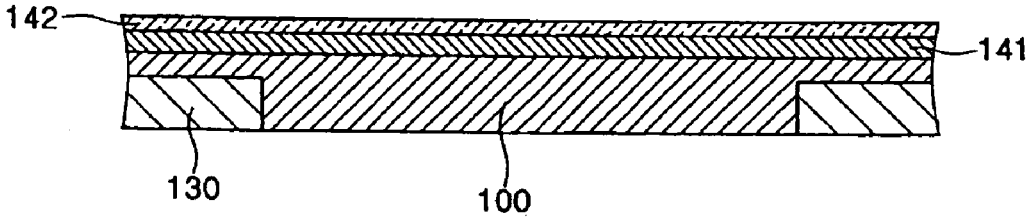
FIGS. 3A to 3E are cross-sectional views illustrating a method of fabricating the inkjet print head of FIG. 2 according to an embodiment of the present general inventive concept.

As illustrated in FIGS. 2 and 3A, a field oxide layer 141 is formed on the substrate 100 using a chemical vapor deposition (CVD) method or a thermal process. An interlayer dielectric layer 142 is formed on the field oxide layer 141. The interlayer dielectric layer 142 may be made of boron phosphorus silicate glass (BPSG). The interlayer dielectric layer 142 may be formed by the CVD method or an atmospheric pressure CVD (APCVD) method.

Figure 3B:
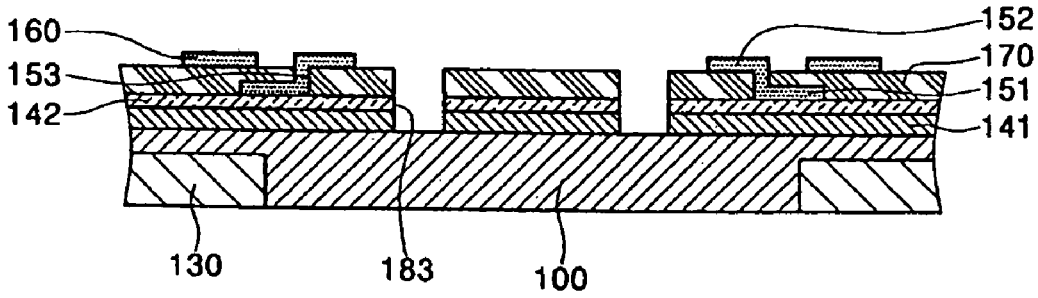

As illustrated in FIGS. 2 and 3B, metal layers are formed on the interlayer dielectric layer 142. The metal layers include a first metal interconnection layer 151, a second metal interconnection layer 152, and a heat resistor layer 160 formed on a portion of the interlayer dielectric layer 142. Other metal layers may also be formed which provide the intended purposes of the present embodiment as described herein. The first metal interconnection layer 151 may be deposited using a sputtering method and then etched using a pattern formed through a lithography process. A material used for the first metal interconnection layer 151 may be selected from Ti, TiN, and Al.

Although not illustrated, the first metal interconnection layer 151 may be connected to the logic region 130. An intermetal dielectric layer 170 is formed on the first metal interconnection layer 151. The intermetal dielectric layer 170 may be formed of oxide using a plasma enhanced CVD (PECVD) method.

A via-hole 153 is formed through the intermetal dielectric layer 170 to the first metal interconnection layer 151. The via-hole 153 may be filled with tungsten (W) using a low-pressure CVD (LPCVD) method or an atomic layer deposition (ALD) method.

The second metal interconnection layer 152 and the heat resistor layer 160 are formed on the intermetal dielectric layer 170 to be in contact with the first metal interconnection layer 151 through the via-hole 153. The second metal interconnection layer 152 and the heat resistor layer 160 may be formed together as a single layer or individually as separate layers on the intermetal dielectric layer 170.

The heat resistor layer 160 may be formed of a high resistance metal such as tantalum or tungsten, an alloy including a high resistance metal such as tantalum nitride (TaN) or tantalum aluminum (TaAl), or polysilicon doped with impurity ions. The second metal interconnection layer 152 and the heat resistor layer 160 may be formed using the sputtering method. The heat resistor layer 160 may include a plurality of heat resistors arranged in two rows. Other arrangements of the heat resistor layer 160 may alternatively be used with the present general inventive concept.

A trench 183 is formed through the intermetal dielectric layer 170, the interlayer dielectric layer 142, and the field oxide layer 141 to surround an area where the ink-feed hole 101 (see FIG. 2) is to be formed. The trench 183 may be formed by a dry etching method, such as a reactive ion etching (RIE) method or an inductive coupled plasma (ICP) etching method. The trench 183 may be formed to have a width of about 5~10 μm, and a depth that exposes the substrate 100. Alternatively, the trench 183 may be etched through the intermetal dielectric layer 170 and the interlayer dielectric layer 142 to expose the field oxide layer 141 instead of the substrate 100

Figure 3C:
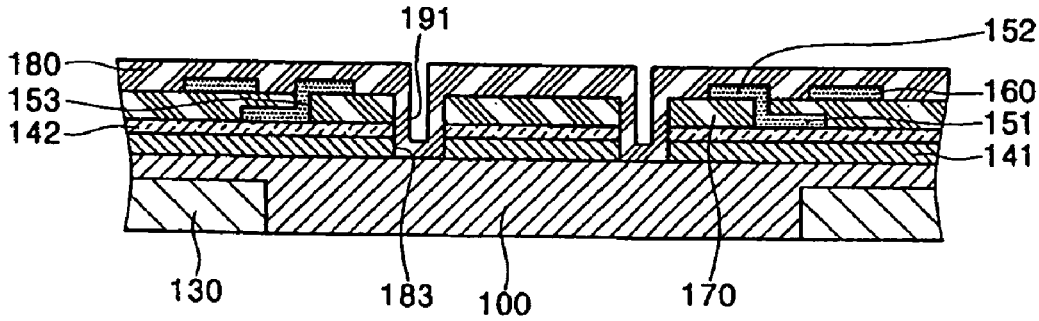

In addition, as illustrated in FIGS. 2 and 3C, a passivation layer 180 is formed on the intermetal dielectric layer 170 to fill the trench 183 and cover the heat resistor layer 160 and the second metal interconnection layer 152. The passivation layer 180 functions to protect the second metal interconnection layer 152 and the heat resistor layer 160 formed thereunder from heat and moisture.

The passivation layer 180 may include a metal passivation layer 181 made of silicon nitride (SiNx) using the PECVD method. The metal passivation layer 181 functions to protect the first metal interconnection layer 151, the second metal interconnection layer 152, and the heat resistor layer 160 formed thereunder. When the metal passivation layer 181 is formed in the trench 183, the metal passivation layer 181 may be formed to have a height that extends from the substrate 100 at the bottom of the trench 183 to a height of the field oxide layer 141, while conforming to a profile of the trench 183.

Figure 3D:
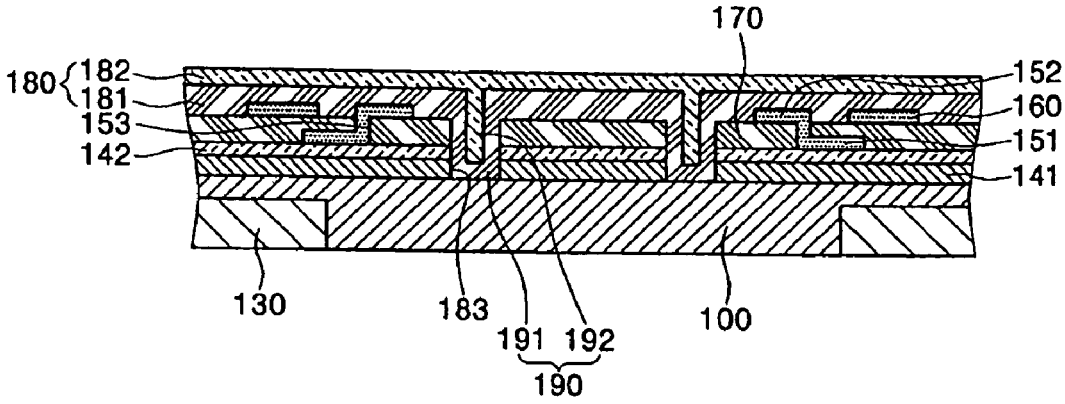

In addition, as illustrated in FIGS. 2 and 3D, the passivation layer 180 includes an anti-cavitation layer 182 formed on the metal passivation layer 181. The anti-cavitation layer 182 and the metal passivation layer 181 may be made of tantalum and silicon nitride, respectively. The anti-cavitation layer 182 functions to protect the layers formed thereunder from a high pressure of hundreds of atmospheres generated when bubbles shrink in the inkjet head. The anti-cavitation layer 182 may be deposited using a sputtering method, and may be formed in the trench where the metal passivation layer 181 is deposited, when the deposition process is performed.

Therefore, a silicon nitride layer 191 that corresponds to the metal passivation layer 181 and a tantalum layer 192 that corresponds to the anti-cavitation layer 182 are sequentially formed in the trench 183 to form an anti-moisture layer 190 disposed in a perpendicular direction between the ink-feed hole 101 (see FIG. 2) and the first metal interconnection layer 151, the second metal interconnection layer 152, the heat resistor layer 160, the intermetal dielectric layer 170, and the interlayer dielectric layer 142 to block moisture from being transferred from the ink-feed hole 101 to the layers 142, 151, 152, 160, and 170. In addition, blocking of moisture is mainly performed by the tantalum layer 192 that is formed in the trench 183 when the anti-cavitation layer 182 is formed.

Generally, tantalum is known to minimize corrosion and interface de-lamination caused by moisture. That is, oxidation is not likely to be generated, and erosion is not likely to result in the tantalum from excessive acid. Therefore, the tantalum performs excellent anti-moisture functions, since corrosion is rarely generated even when the anti-moisture layer 190 is directly exposed to ink. As a result, the anti-moisture layer 190 can effectively block moisture that would be absorbed through an end of the interlayer dielectric layer 142 is the interlayer dielectric layer 142 is exposed to the ink-feed hole 101.

Figure 3E:
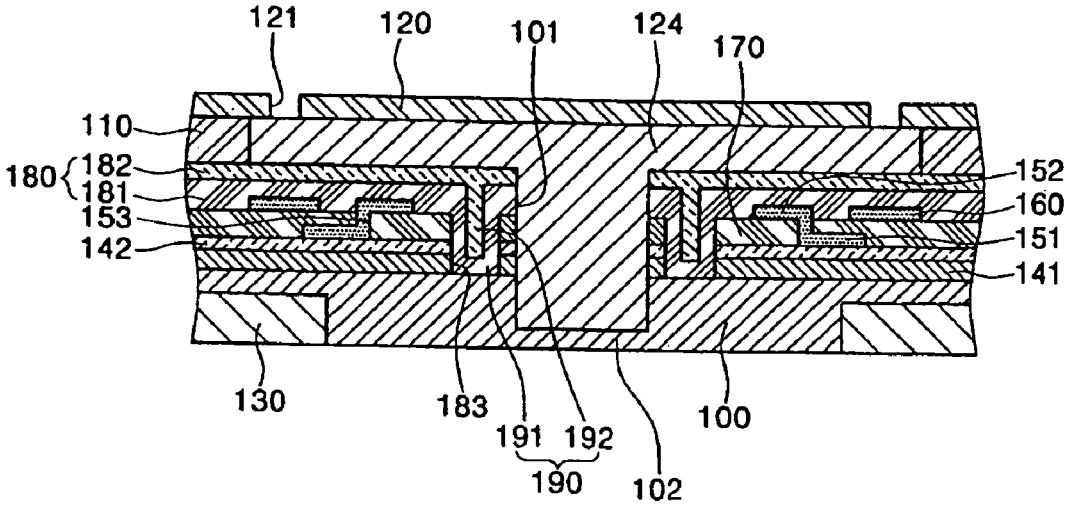

As illustrated in FIGS. 2 and 3E, the ink-feed hole 101 is then formed. When the ink-feed hole 101 is formed, the substrate 100 is not fully etched through, leaving a remaining layer 102 of a predetermined thickness. The ink-feed hole 101 is formed between the anti-moisture layers 190 and is spaced apart therefrom. The ink-feed hole 101 may be formed by a magnetron-enhanced plasma etching method or an induced coupled plasma etching method.

A chamber layer 110 is then formed. The chamber layer 110 is applied by forming a sacrificial layer 124 in the ink-feed hole 101 and on a portion of the passivation layer 180. A photosensitive dry film is then hot-pressed onto another portion of the passivation layer 180 using a lamination method. The photosensitive dry film may be a product such as VACREL or RISTON available from DuPont Inc.

A nozzle layer 120 is then formed on the chamber layer 110. Nozzles 121 are formed in the nozzle layer 120. The nozzle layer 120 may be formed by a nickel electrolytic plating process, a micro punching process, or a polishing process. The nozzles 121 formed in the nozzle layer 120 are arranged to be located directly over chambers 111 and the heat resistor layers 160.

The remaining layer 102 left in the ink-feed hole 101 is then etched to extend the ink-feed hole 101 through the substrate 100, and the sacrificial layer 124 is removed to form an ink passage 123, thereby completing the inkjet print head as illustrated in FIG. 2. The sacrificial layer 124 may be formed of organic compounds and may be removed using solvent.

The remaining layer 102 may be removed through a bottom surface of the substrate 100 using a lithography process and an etching process, and may be removed before or after removing the sacrificial layer 124.

Figure 4:
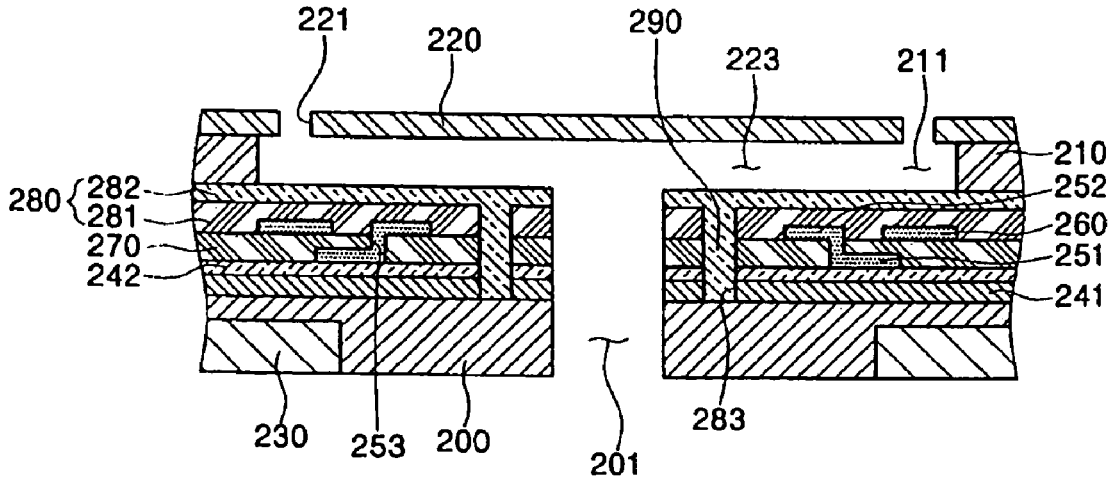
FIG. 4 is a cross-sectional view of an inkjet print head according to another embodiment of the present general inventive concept.

FIG. 4 is a cross-sectional view of an inkjet print head according to another embodiment of the present general inventive concept, and FIGS. 5A to 5E are cross-sectional views illustrating a method of fabricating the inkjet print head of FIG. 4 according to another embodiment of the present general inventive concept.

Figure 5A:
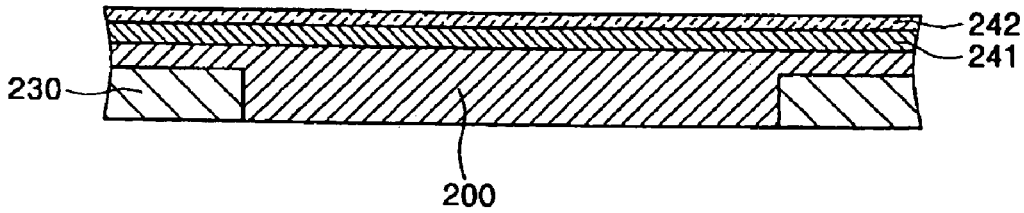
FIGS. 5A to 5E are cross-sectional views illustrating a method of fabricating the inkjet print head of FIG. 4 according to another embodiment of the present general inventive concept.

As illustrated in FIGS. 4 and 5A, the inkjet print head has a substrate 200. A logic region 230, including driving devices to drive a heat resistor layer 260 that generates pressure in the inkjet print head, is formed on a portion of an upper surface of the substrate 200. A field oxide layer 241 and an inter layer dielectric layer 242 are formed on the substrate 200.

Figure 5B:
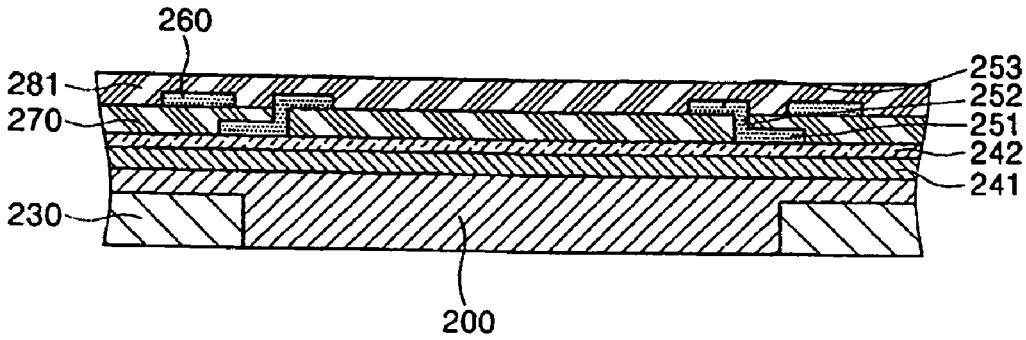

As illustrated in FIGS. 4 and 5B, metal layers are formed on the interlayer dielectric layer 242. The metal layers include a first metal interconnection layer 251, a second metal interconnection layer 252, and a heat resistor layer 260, formed on a portion of the interlayer dielectric layer 242. An intermetal dielectric layer 270 is formed on the first metal interconnection layer 251. A via-hole 253 is formed through the intermetal dielectric layer 270 to the first metal interconnection layer 251, and the second metal interconnection layer 252 is formed on the intermetal dielectric layer 270 to be in contact with the first metal interconnection layer 251 through the via-hole 253. The second metal interconnection layer 252 and the heat resistor layer 260 that generate the pressure in the inkjet head may be formed together as a single layer or individually as separate layers, on the intermetal dielectric layer 270. Process operations performed up to this point are similar to process operations performed in previous embodiments.

A passivation layer 280 (see FIG. 4, 5D, or 5E) is then formed on the intermetal dielectric layer 270 to cover the heat resistor layer 260 and the second metal interconnection layer 252. The passivation layer 280 may include a metal passivation layer 281 made of silicon nitride (SiNx) using a PECVD method. The metal passivation layer 281 functions to protect the second metal interconnection layer 252 and the heat resistor layer 260 that are formed thereunder.

Figure 5C:
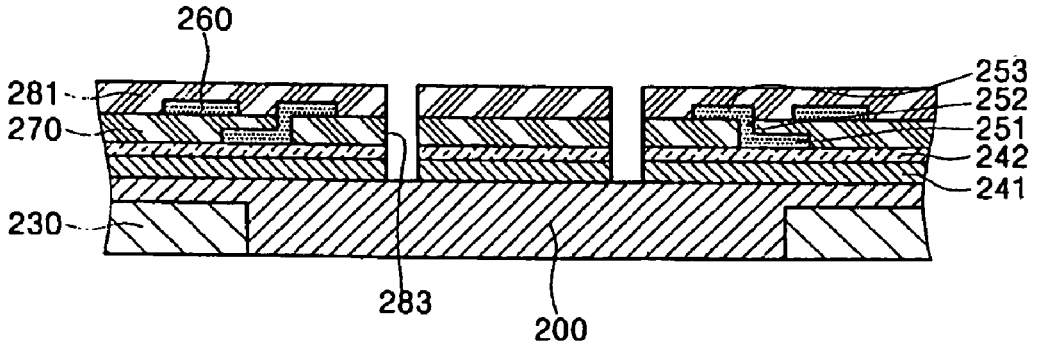

As illustrated in FIGS. 4 and 5C, a trench 283 is formed through the metal passivation layer 281, the intermetal dielectric layer 270, the interlayer dielectric layer 242, and the field oxide layer 241 around a region where an ink-feed hole 201 (see FIG. 4) is to be formed to surround the ink-feed hole 201. The trench 283 is formed by a dry etching method to have a width of about 5~10 μm and a depth that exposes the substrate 200. Alternatively, the trench 283 may be etched through the metal passivation layer 281, the intermetal dielectric layer 270, and the interlayer dielectric layer 242 to expose the field oxide layer 241 instead of the substrate 200.

Figure 5D:
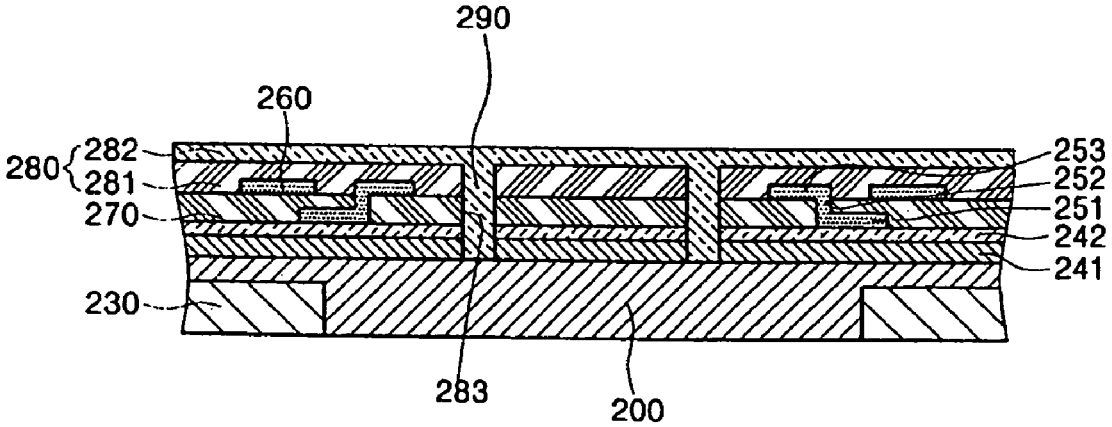

In addition, as illustrated in FIGS. 4 and 5D, the passivation layer 280 includes an anti-cavitation layer 282 formed of tantalum on the metal passivation layer 281 using a sputtering method. The anti-cavitation layer 282 may be formed in the trench 283 using tantalum to conform to a profile of the trench 283. As a result, an anti-moisture layer 290 made of tantalum is formed in a perpendicular direction between the region where the ink-feed hole 201 (see FIG. 4) is to be formed and the first metal interconnection layer 251, the second metal interconnection layer 252, the heat resistor layer 260, the intermetal dielectric layer 270, and the interlayer dielectric layer 242.

Figure 5E:
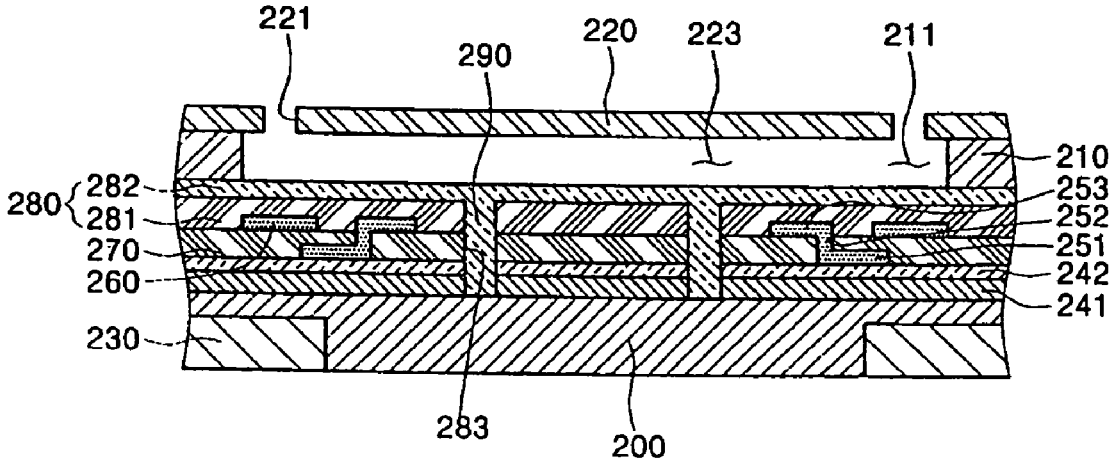

As illustrated in FIGS. 4 and 5E, the ink-feed hole 201 (see FIG. 4), a chamber layer 210, a chamber 211, and a nozzle layer 220 having nozzles 221 are formed using process operations similar to those used in previous embodiments, thereby completing the inkjet print head of FIG. 4. <Embodiment 3>

Figure 6:
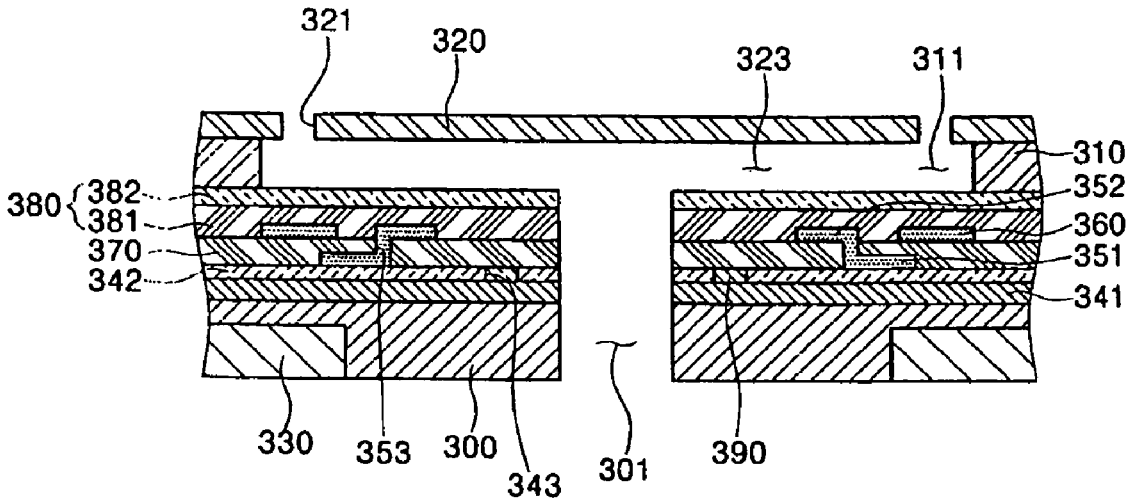
FIG. 6 is a cross-sectional view of an inkjet print head according to another embodiment of the present general inventive concept.

FIG. 6 is a cross-sectional view of an inkjet print head according to another embodiment of the present general inventive concept, and FIGS. 7A to 7D are cross-sectional views illustrating a method of fabricating the inkjet print head of FIG. 6 according to another embodiment of the present general inventive concept.

Figure 7A:
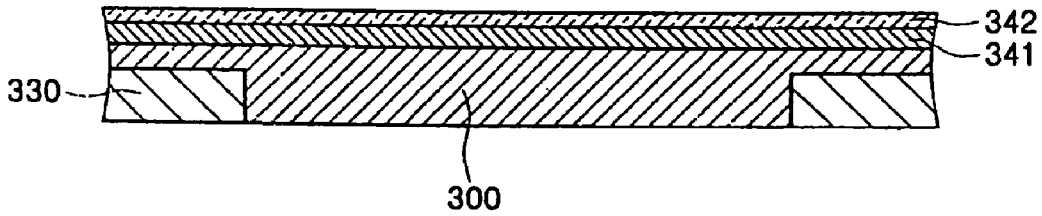
FIGS. 7A to 7D are cross-sectional views illustrating a method of fabricating the inkjet print head of FIG. 6 according to another embodiment of the present general inventive concept.

As illustrated in FIGS. 6 and 7A, the inkjet print head has a substrate 300. A logic region 330 including driving devices to drive a heat resistor layer 360 in the inkjet print head is formed on a portion of an upper surface of the substrate 300. A field oxide layer 341 and an interlayer dielectric layer 342 are formed on the substrate 300. Process operations performed up to this point are similar to process operations performed in the previous embodiments.

Figure 7B:
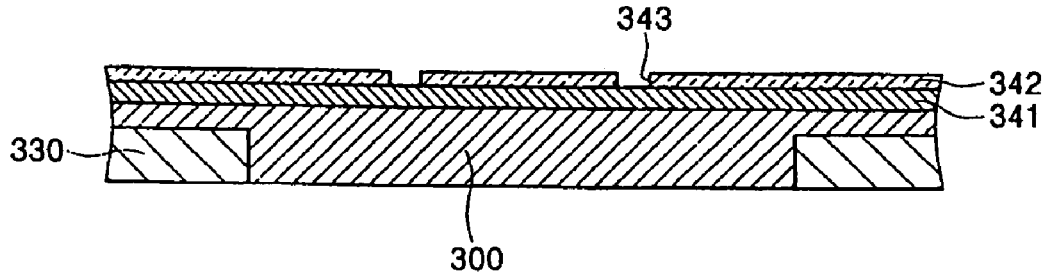

As illustrated in FIGS. 6 and 7B, once the interlayer dielectric layer 342 is formed, a trench 343 is formed in the interlayer dielectric layer 342 to surround a region where an ink-feed hole 301 (see FIG. 6) is to be formed. The trench 343 may be formed by a lithography process and a dry etching process to have a width of about 5~10 μm and a depth that exposes the substrate 300. Alternatively, the trench 343 may be etched through the interlayer dielectric layer 342 to expose the field oxide layer 341.

Figure 7C:
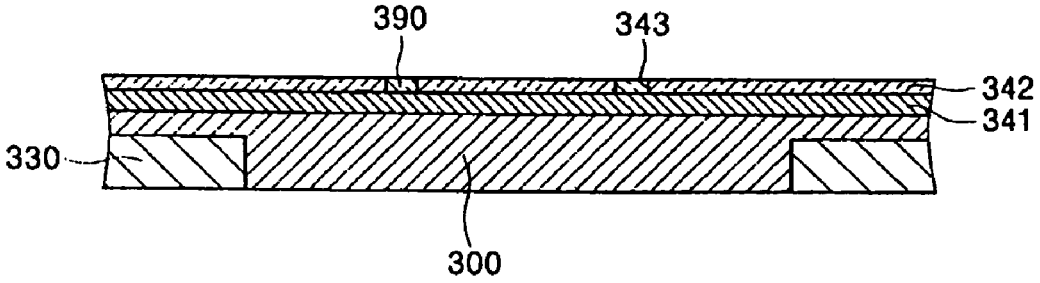

In addition, as illustrated in FIGS. 6 and 7C, the trench 343 is filled with corrosion resistant metals or an alloy thereof to form an anti-moisture layer 390. That is, the anti-moisture layer 390 is made of a corrosion resistant metal selected from a group including stainless steel, nickel, monel, hastelloy, lead, aluminum, tin, titanium, tantalum, and any alloy thereof. Alternatively, other corrosion resistant metals or combinations thereof may also be used with the present embodiment. Further, it is possible to improve corrosion resistance characteristics by adjusting reaction gas when the anti-moisture layer 390 is deposited.

The anti-moisture layer 390 is formed by forming a photo-mask such that the trench 343 is exposed through the interlayer dielectric layer 342, and then filling the trench 343 with the corrosion resistant metal using a sputtering method. Since a first metal interconnection layer 351 is formed on the interlayer dielectric layer 342 after removing the photo-mask (and after the corrosion resistant metal is deposited in the trench 343), it is possible to employ a planarization process using a chemical-mechanical polishing (CMP) method to planarize a surface of the interlayer dielectric layer 342 with a surface of the anti-moisture layer 390.

Figure 7D:
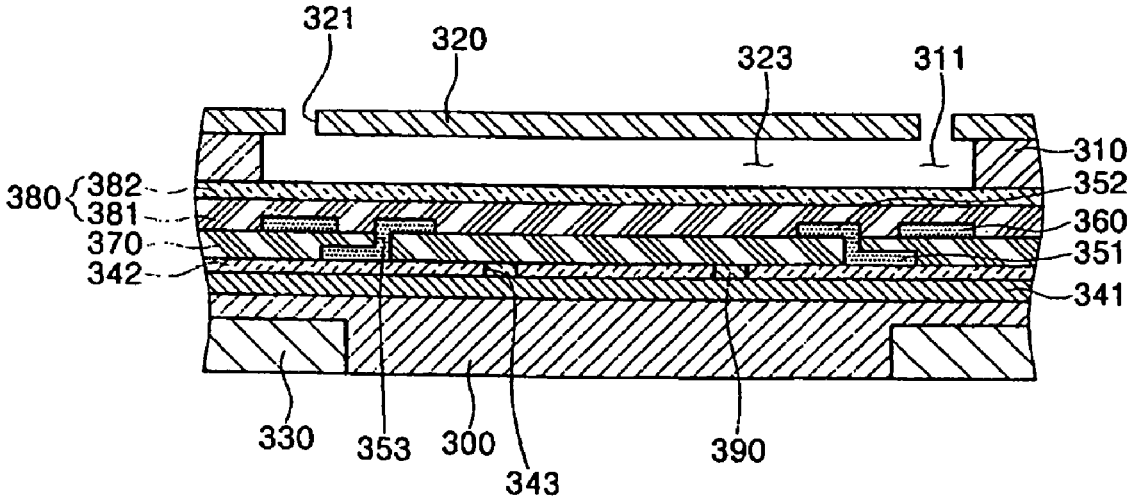

As illustrated in FIGS. 6 and 7D, metal layers are formed on the interlayer dielectric layer 342. The metal layers include a first metal interconnection layer 351, a second metal interconnection layer 352, and a heat resistor layer 360. An intermetal dielectric layer 370 is formed on the first metal interconnection layer 351, and a via-hole 353 is formed through the intermetal dielectric layer 370 to the first metal interconnection layer 351. The second metal interconnection layer 352 is formed on the intermetal dielectric layer 370 to be in contact with the first metal interconnection layer 351 through the via-hole 353.

The second metal interconnection layer 352 and the heat resistor layer 360, which generate pressure in the inkjet print head, may be formed together as a single layer or individually as separate layers on the intermetal dielectric layer 370. A passivation layer 380 is then formed on the intermetal dielectric layer 370 to cover the heat resistor layer 360 and the second metal interconnection layer 352. The passivation layer 380 includes a metal passivation layer 381 made of silicon nitride (SiNx) using a PECVD method, and an anti-cavitation layer 382 formed of tantalum on the metal passivation layer 381. The ink-feed hole 301 (see FIG. 6), a chamber 311 and a chamber layer 310, and a nozzle layer 320 having nozzles 321, are then formed using process operations that are similar to those used in the previous embodiments, thereby completing the inkjet print head.

Figure 8:
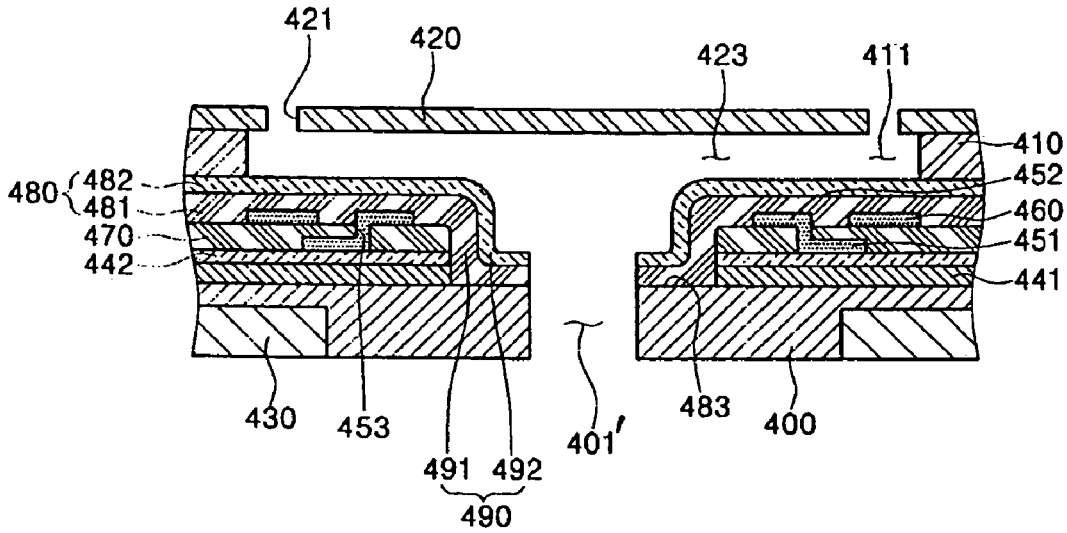
FIG. 8 is a cross-sectional view of an inkjet print head according to another embodiment of the present general inventive concept.

FIG. 8 is a cross-sectional view of an inkjet print head according to another embodiment of the present general inventive concept, and FIGS. 9A to 9F are cross-sectional views illustrating a method of fabricating the inkjet print head of FIG. 8 according to another embodiment of the present general inventive concept.

Figure 9A:
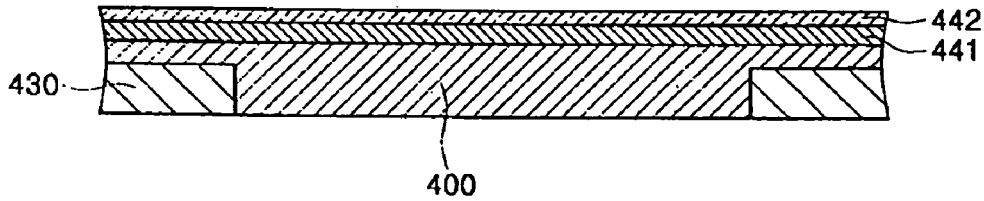
FIGS. 9A to 9F are cross-sectional views illustrating a method of fabricating the inkjet print head of FIG. 8 according to another embodiment of the present general inventive concept.
Figure 9B:
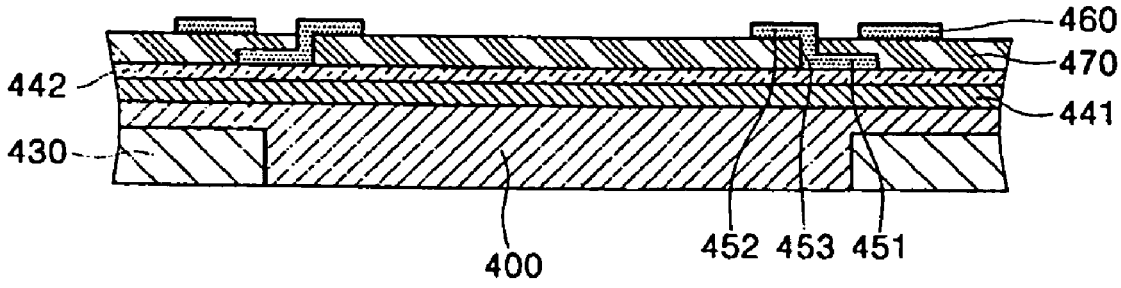

As illustrated in FIGS. 8, 9A, and 9B, the inkjet print head has a substrate 400. A logic region 430 including driving devices to drive a heat resistor layer 460 in the inkjet print head is formed on a portion of an upper surface of the substrate 400. A field oxide layer 441 and an interlayer dielectric layer 442 are sequentially formed on the substrate 400. A first metal interconnection layer 451, a via-hole 453, a second metal interconnection layer 452, and the heat resistor layer 460 are sequentially formed on the interlayer dielectric layer 442. Process operations performed up to this point are similar to process operations performed in the previous embodiments.

Figure 9C:
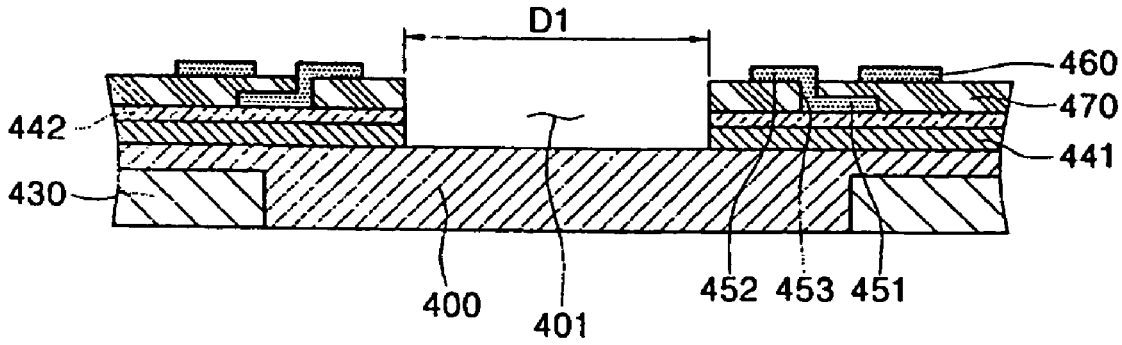

As illustrated in FIGS. 8 and 9C, a first ink-feed hole 401 is partially formed on the substrate 400 from an intermetal dielectric layer 470 to a surface of the substrate 400 using a dry etching method. In addition, the first ink-feed hole 401 formed on the substrate 400 has a greater width D1 than a width D2 of a second ink-feed hole 401' (see FIG. 8) that is to be formed to extend through the substrate 400 (see FIGS. 9C and 9F, D1>D2). Accordingly, as illustrated in FIG. 9D, a step 483 is formed on the substrate 400.

Figure 9D:
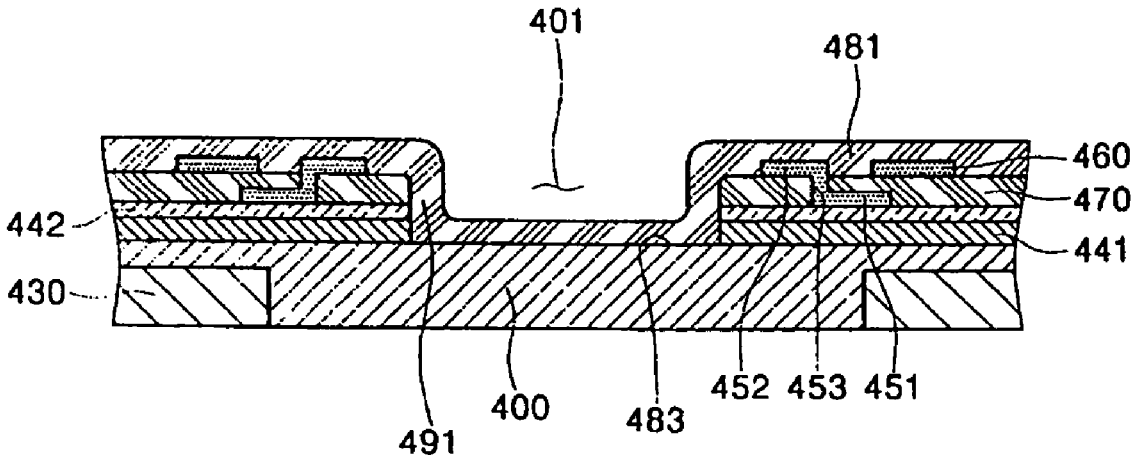

In addition, as illustrated in FIGS. 8 and 9D, a passivation layer 480 is formed on the intermetal dielectric layer 470 to fill the first ink-feed hole 401 and cover the heat resistor layer 460 and the second metal interconnection layer 452. The passivation layer 480 includes a metal passivation layer 481 to protect the first metal interconnection layer 451, the second metal interconnection layer 452, and the heat resistor layer 460 that are formed thereunder. The metal passivation layer 481 may be formed from a bottom surface of the step 483 of the first ink-feed hole 401, to a thickness (i.e., height) that corresponds to a thickness of the field oxide layer 441.

Figure 9E:
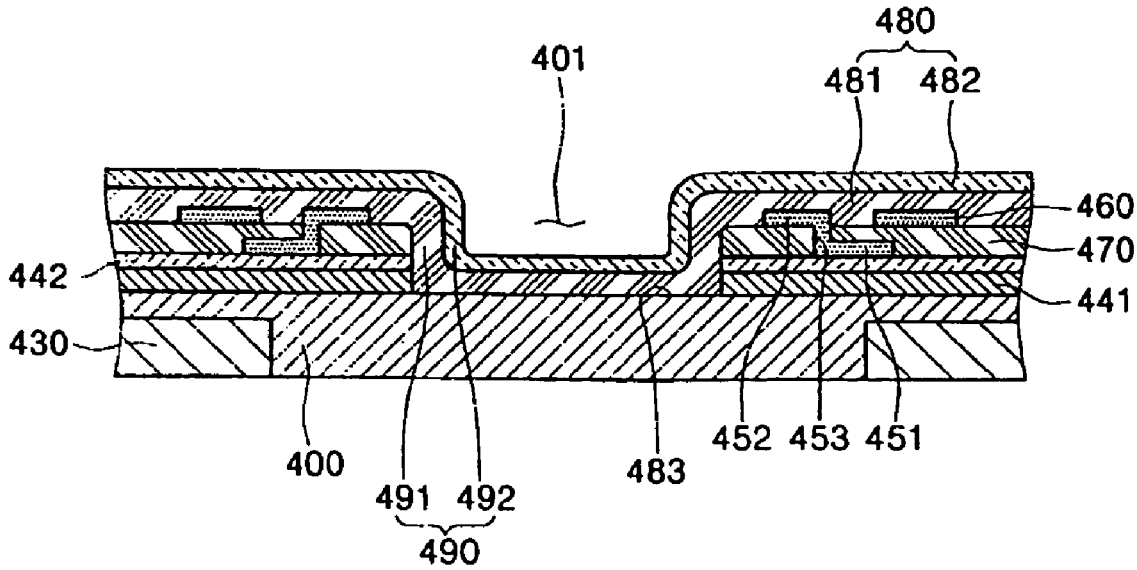
Figure 9F:
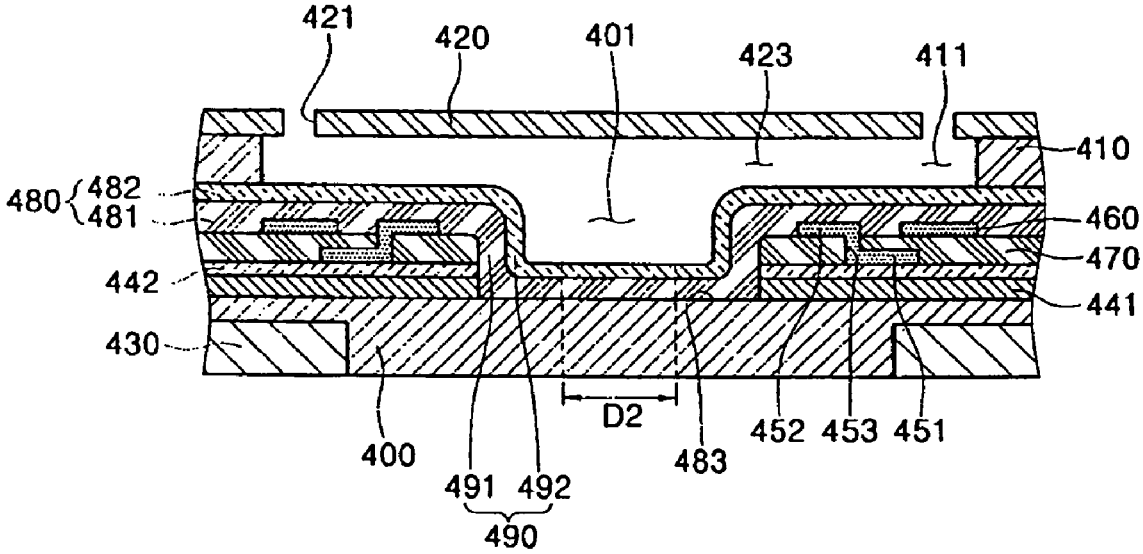

As illustrated in FIGS. 8 and 9E, the passivation layer 480 further includes an anti-cavitation layer 482 made of tantalum deposited on the metal passivation layer 481. The anti-cavitation layer 482 is deposited on the metal passivation layer 481 using a sputtering method, thereby forming an anti-moisture layer 490 that is recessed into the first ink-feed hole 401 (i.e., onto the step 483). A bottom surface of the anti-moisture layer 490 may be formed level with or lower than a bottom surface of the field oxide layer 441, and a top surface of the anti-moisture layer 490 may be formed higher than a top surface of the interlayer dielectric layer 442.

As illustrated in FIG. 8, the second ink-feed hole 401' is formed to extend entirely through the substrate 400 using a dry etching method. At this time, in order to effectively maintain the shape of the anti-moisture layer 490, the substrate 400 is etched such that the second ink-feed hole 401' has the width D2 that is smaller than the width D1 of the first ink-feed hole 401 formed on the substrate 400. Next, a chamber 411 and a chamber layer 410, and a nozzle layer 421 having nozzles 420, are formed using similar process operations to those used in previous embodiments, thereby completing the head.

Although embodiments of the present general inventive concept are described as having first and second metal interconnection layers, an interlayer dielectric layer, an intermetal dielectric layer, etc., it should be understood that other conductive, insulative, and dielectric layers may be used with the present general inventive concept.

As can be seen from the foregoing description, the inkjet print head and the method of fabricating the same of various embodiments of the present general inventive concept are capable of preventing problems such as de-lamination between layers, electrical short-circuit, circuit malfunction, and corrosion of metal interconnection layers, by preventing penetration of ink moisture from layers having absorbent characteristics into the metal interconnection layers, a logic region, or a pressure driving part. As a result, it is possible to increase the lifespan and reliability of the inkjet print head, as well as to increase productivity and reduce manufacturing cost by increasing yield.

Although various embodiments of the present general inventive concept have been shown and described, it should be appreciated by those skilled in the art that changes may be made in these embodiments without departing from the principles and spirit of the general inventive concept, the scope of which is defined in the appended claims and their equivalents.

What is claimed is:

1. An inkjet print head, comprising:

a substrate having an ink-feed hole;

an interlayer dielectric layer formed around the ink-feed hole on the substrate;

at least one metal layer formed on the interlayer dielectric layer; and an anti-moisture part formed between the ink-feed hole and the at least one metal layer to prevent ink moisture in the ink-feed hole from contacting the at least one metal layer and the interlayer dielectric layer.

2. The inkjet print head according to claim 1, wherein a logic region is formed on the substrate, and the anti-moisture part is formed between the ink-feed hole and the logic region.

3. The inkjet print head according to claim 1, wherein the anti-moisture part comprises an anti-moisture layer filling in a portion of the interlayer dielectric layer.

4. The inkjet print head according to claim 3, wherein the interlayer dielectric layer comprises boron phosphorus silicate glass.

5. The inkjet print head according to claim 3, wherein the anti-moisture layer comprises one of stainless steel, nickel, monel, hastelloy, lead, aluminum, tin, titanium, and tantalum.

6. The inkjet print head according to claim 1, wherein the at least one metal layer comprises:

a first metal interconnection layer;

a second metal interconnection layer in contact with the first metal interconnection layer; and a heat resister layer in contact with the second metal interconnection layer to generate pressure in the inkjet print head.

7. The inkjet print head according to claim 6, wherein the substrate comprises:

a field oxide layer;

the interlayer dielectric layer formed on the field oxide layer;

the first metal interconnection layer formed on the interlayer dielectric layer;

an intermetal dielectric layer formed on the first metal interconnection layer;

the second metal interconnection layer formed on the intermetal dielectric layer;

the heat resistor layer formed on the intermetal dielectric layer at a position different from the second metal interconnection layer; and a passivation layer formed on the second metal interconnection layer and the heat resistor layer.

8. The inkjet print head according to claim 7, wherein the anti- moisture part comprises:

a trench formed around the ink-feed hole and extending from the passivation layer to the substrate; and an anti-moisture layer filling the trench.

9. The inkjet print head according to claim 8, wherein the passivation layer and the anti-moisture layer are formed of tantalum.

10. The inkjet print head according to claim 8, wherein the passivation layer comprises a metal passivation layer and an anti-cavitation layer, and the anti-moisture layer is formed together with the metal passivation layer and the anti-cavitation layer.

11. The inkjet print head according to claim 10, wherein the metal passivation layer is made of silicon nitride and the anti-cavitation layer is made of tantalum.

12. The inkjet print head according to claim 1, wherein a passivation layer is formed on the at least one metal layer, and the anti-moisture part comprises a step formed around the ink-feed hole toward the substrate and an anti-moisture layer formed on the step together with the passivation layer.

13. The inkjet print head according to claim 12, wherein the passivation layer comprises:

a metal passivation layer made of silicon nitride; and an anti-cavitation layer made of tantalum and deposited on the metal passivation layer.

14. The inkjet print head according to claim 12, wherein the anti-moisture layer is formed of a layered structure of silicon nitride and tantalum.

15. An inkjet print head, comprising:

a substrate having an ink feed hole extending therethrough;

at least one pressure-generating element disposed on the substrate adjacent to the ink feed hole; and at least one protective layer having a parallel part extending parallel to the substrate over the at least one pressure-generating element and a non-parallel part extending toward the substrate adjacent the ink feed hole to provide a barrier between the at least one pressure generating element and the ink feed hole, wherein the non-parallel part of the at least one protective layer comprises a perpendicular part to extend perpendicularly to the substrate to isolate the at least one pressure generating element from the ink feed hole in conjunction with the parallel part of the at least one protective layer.

16. The inkjet print head according to claim 15, wherein the non-parallel part of the at least one protective layer comprises a tantalum anti-moisture part.

17. The inkjet print head according to claim 15, wherein the at least one pressure-generating element comprises at least one heat resistor, and the inkjet print head further comprises:

at least one metal layer disposed on the substrate to provide a driving current to the heat resistor;

an intermetal layer disposed on the at least one metal layer; and a heat resistor layer that defines the at least one heat resistor disposed on the intermetal layer to receive the driving current from the at least one metal layer through the intermetal layer.

18. The inkjet print head according to claim 17, wherein the non-parallel part of the at least one protective layer extends through the at least one metal layer, the intermetal later, and the heat resistor layer to the substrate.

19. The inkjet print head according to claim 17, wherein the parallel part of the at least one protective layer comprises a passivation layer and the non-parallel part of the at least one protective layer comprises an anti-moisture part to block moisture in the ink feed hole from the at least one metal layer, the intermetal layer, and the heat resistor layer.

20. The inkjet print head according to claim 19, further comprising:

at least one ink chamber to correspond with the at least one heat resistor, wherein the parallel part of the at least one protective layer further comprises an anti-cavitation layer to prevent damage to the at least one heat resistor from pressure exerted by bubbles in the at least one ink chamber.

21. The inkjet print head according to claim 17, further comprising:

an interlayer dielectric layer disposed between the substrate and the at least one metal layer; and a via hole disposed in the intermetal layer through which the at least one metal layer provides the driving current to the at least one heat resistor.

22. The inkjet print head according to claim 21, wherein the interlayer dielectric layer has moisture absorbing characteristics.

23. The inkjet print head according to claim 21, wherein the at least one protective layer comprises:

a passivation layer disposed on the heat resistor layer to protect the at least one heat resistor and having a U-shaped recess adjacent to the ink feed hole at the non-parallel part of the at least one protective layer; and an anti-cavitation layer disposed on the passivation layer and extending into the U-shaped recess of the passivation layer at the non-parallel part of the at least one protective layer.

24. The inkjet head according to claim 21, wherein the at least one protective layer comprises:

a passivation layer disposed on the heat resistor layer to protect the at least one heat resistor and extending to the ink feed hole; and an anti-cavitation layer disposed on the passivation layer and extending through the passivation layer, the heat resistor layer, the intermetal layer, the at least one metal layer, and the interlayer dielectric layer to the substrate at the non-parallel part of the at least one protective layer adjacent to the ink feed hole.

25. The inkjet print head according to claim 24, wherein the anti-cavitation layer has a T-shape.

26. The inkjet print head according to claim 21, wherein the at least one protective layer comprises:

a passivation layer disposed at the parallel part of the at least one protective layer on the heat resistor layer to protect the at least one heat resistor and extending to the ink feed hole;

an anti-cavitation layer disposed on the passivation layer extending to the ink-feed hole; and an anti-moisture part disposed at the non-parallel part of the at least one protective layer in a slit in the interlayer dielectric layer adjacent to the ink feed hole to prevent the interlayer dielectric layer from absorbing moisture from ink in the ink feed hole.

27. The inkjet print head according to claim 21, wherein an end of the intermetal and interlayer dielectric layers form a ledge adjacent to the ink feed hole with respect to a surface of the substrate, and the parallel part of the at least one protective layer is disposed on the heat resistor layer and the non-parallel part of the at least one protective layer is recessed onto the ledge adjacent to the ink feed hole.

28. The inkjet print head according to claim 27, wherein the at least one protective layer comprises a passivation layer comprising silicon nitride and an anti-cavitation layer comprising tantalum.

29. The inkjet print head according to claim 21, further comprising:

a logic region including at least one driving device to drive the at least one heat resistor, wherein the at least one metal layer comprises:

a first metal interconnection layer disposed on the inter-layer dielectric layer to receive the driving current from the logic region, and a second metal interconnection layer in contact with the first metal interconnection layer through the inter-metal layer to receive the driving current therefrom and apply the driving current to the at least one heat resistor.

30. The inkjet print head according to claim 17, wherein the intermetal layer comprises an oxide intermetal dielectric layer.

31. The inkjet print head according to claim 15, further comprising:

a chamber layer to define at least one ink chamber having the at least one pressure generating element disposed therein; and a nozzle layer to define at least one nozzle disposed above the at least one pressure- generating element and that corresponds to the at least one ink chamber.

32. An inkjet print head, comprising:

a substrate having an ink feed hole extending therethrough;

one or more layers disposed on the substrate;

at least one heat resistor disposed on the one or more layers on each side of the ink feed hole; and at least one anti-moisture part disposed adjacent to the ink feed hole on each side thereof and in contact with the substrate to prevent moisture in ink that flows through the ink feed hole from contacting or being absorbed by the one or more layers.

33. The inkjet print head according to claim 32, wherein the one or more layers comprise at least one dielectric layer having absorbing characteristics and at least one metal layer to provide current to the at least one heat resistor.

34. The inkjet print head according to claim 32, further comprising:

a protection layer disposed over the at least one heat resistor on each side of the ink feed hole, wherein the at least one anti-moisture part extends from the protection layer to the substrate to form a seal of the one or more layers in conjunction with the protection layer.

35. An inkjet print head, comprising:

a substrate having an ink feed hole;

plurality of layers disposed on the substrate; and an anti-moisture part disposed between the ink feed hole and each of the plurality of layers to prevent ink from contacting or being absorbed by any of the plurality of layers.

36. The inkjet print head of claim 35, wherein at least one of the plurality of layers comprises an interlayer dielectric layer formed around the ink-feed hole.

* * * * *